US008228267B2

(12) United States Patent
Leon

(10) Patent No.: US 8,228,267 B2
(45) Date of Patent: Jul. 24, 2012

(54) ELECTROLUMINESCENT DISPLAY WITH EFFICIENCY COMPENSATION

(75) Inventor: Felipe A. Leon, Rochester, NY (US)

(73) Assignee: Global OLED Technology LLC, Herndon, VA (US)

( * ) Notice: Subject to any disclaimer, the term of this patent is extended or adjusted under 35 U.S.C. 154(b) by 922 days.

(21) Appl. No.: 12/260,103

(22) Filed: Oct. 29, 2008

(65) Prior Publication Data

US 2010/0103159 A1 Apr. 29, 2010

(51) Int. Cl.
*G09G 3/30* (2006.01)
*G09G 3/32* (2006.01)

(52) U.S. Cl. ..... 345/76; 345/212; 345/82; 345/204

(58) Field of Classification Search ..... 345/76, 345/212
See application file for complete search history.

(56) References Cited

U.S. PATENT DOCUMENTS

| | | | | |
|---|---|---|---|---|
| 6,414,661 | B1 | 7/2002 | Shen et al. | |
| 6,456,016 | B1 | 9/2002 | Sundahl et al. | |
| 6,504,565 | B1 | 1/2003 | Narita et al. | |
| 6,995,519 | B2 | 2/2006 | Arnold et al. | |
| 7,956,830 | B2 * | 6/2011 | Chen et al. | 345/82 |
| 2002/0167474 | A1 | 11/2002 | Everitt | |
| 2003/0122813 | A1 | 7/2003 | Ishizuki et al. | |
| 2006/0158402 | A1 * | 7/2006 | Nathan et al. | 345/82 |
| 2006/0273997 | A1 | 12/2006 | Nathan et al. | |
| 2007/0195020 | A1 | 8/2007 | Nathan et al. | |
| 2008/0001854 | A1 * | 1/2008 | Hamer et al. | 345/76 |
| 2008/0018568 | A1 * | 1/2008 | Chen et al. | 345/82 |
| 2008/0048951 | A1 | 2/2008 | Naugler, Jr. et al. | |
| 2008/0218499 | A1 * | 9/2008 | Kohno et al. | 345/204 |
| 2008/0252569 | A1 * | 10/2008 | Kwon | 345/76 |
| 2008/0252570 | A1 * | 10/2008 | Kwon | 345/76 |
| 2009/0167644 | A1 * | 7/2009 | White et al. | 345/76 |

FOREIGN PATENT DOCUMENTS

| | | |
|---|---|---|
| JP | 2002-278514 | 9/2002 |
| WO | WO2005/109389 A1 | 11/2005 |

* cited by examiner

*Primary Examiner* — Amare Mengistu
*Assistant Examiner* — Sarvesh J Nadkarni
(74) *Attorney, Agent, or Firm* — Morgan, Lewis & Bockius LLP

(57) ABSTRACT

An electroluminescent (EL) subpixel having a readout transistor is driven by a current source when the drive transistor is non-conducting. This produces an emitter-voltage signal from which an aging signal representing the efficiency of the EL emitter can be computed. The aging signal is used to adjust an input signal to produce a compensated drive signal to compensate for changes in efficiency of the EL emitter.

13 Claims, 6 Drawing Sheets

ELECTROLUMINESCENT DISPLAY WITH EFFICIENCY COMPENSATION

CROSS REFERENCE TO RELATED APPLICATIONS

Reference is made to commonly-assigned, co-pending U.S. patent application U.S. Ser. No. 11/766,823 entitled "OLED Display with Aging and Efficiency Compensation" by Levey et al, dated Jun. 22, 2007, incorporated by reference herein.

FIELD OF THE INVENTION

The present invention relates to solid-state electroluminescent flat-panel displays and more particularly to such displays having ways to compensate for efficiency loss of the electroluminescent display components.

BACKGROUND OF THE INVENTION

Electroluminescent (EL) devices have been known for some years and have been recently used in commercial display devices. Such devices employ both active-matrix and passive-matrix control schemes and can employ a plurality of subpixels. Each subpixel contains an EL emitter and a drive transistor for driving current through the EL emitter The subpixels are typically arranged in two-dimensional arrays with a row and a column address for each subpixel, and having a data value associated with the subpixel. Subpixels of different colors, such as red, green, blue, and white are grouped to form pixels. EL displays can be made from various emitter technologies, including coatable-inorganic light-emitting diode, quantum-dot, and organic light-emitting diode (OLED).

Solid-state OLED displays are of great interest as a superior flat-panel display technology. These displays utilize current passing through thin films of organic material to generate light. The color of light emitted and the efficiency of the energy conversion from current to light are determined by the composition of the organic thin-film material. Different organic materials emit different colors of light. However, as the display is used, the organic materials in the display age and become less efficient at emitting light. This reduces the lifetime of the display. The differing organic materials can age at different rates, causing differential color aging and a display whose white point varies as the display is used. In addition, each individual pixel can age at a rate different from other pixels, resulting in display nonuniformity.

The rate at which the materials age is related to the amount of current that passes through the display and, hence, the amount of light that has been emitted from the display. One technique to compensate for this aging effect in polymer light-emitting diodes is described in U.S. Pat. No. 6,456,016 by Sundahl et al. This approach relies on a controlled reduction of current provided at an early stage of use followed by a second stage in which the display output is gradually decreased. This solution requires that a timer within the controller, which then provides a compensating amount of current, track the operating time of the display. Moreover, once a display has been in use, the controller must remain associated with that display to avoid errors in display operating time. This technique has the disadvantage of not representing the performance of small-molecule organic light emitting diode displays well. Moreover, the time the display has been in use must be accumulated, requiring timing, calculation, and storage circuitry in the controller. Also, this technique does not accommodate differences in behavior of the display at varying levels of brightness and temperature and cannot accommodate differential aging rates of the different organic materials.

U.S. Pat. No. 6,414,661 by Shen et al. describes a method and associated system to compensate for long-term variations in the light-emitting efficiency of individual OLED emitters in an OLED display by calculating and predicting the decay in light output efficiency of each pixel based on the accumulated drive current applied to the pixel. The method derives a correction coefficient that is applied to the next drive current for each pixel. This technique requires the measurement and accumulation of drive current applied to each pixel, requiring a stored memory that must be continuously updated as the display is used, and therefore requiring complex and extensive circuitry.

US Patent Application No. 2002/0167474 by Everitt describes a pulse width modulation driver for an OLED display. One embodiment of a video display comprises a voltage driver for providing a selected voltage to drive an organic light-emitting diode in a video display. The voltage driver can receive voltage information from a correction table that accounts for aging, column resistance, row resistance, and other diode characteristics. In one embodiment of the invention, the correction tables are calculated prior to or during normal circuit operation. Since the OLED output light level is assumed to be linear with respect to OLED current, the correction scheme is based on sending a known current through the OLED diode for a duration sufficiently long to permit the transients to settle out, and then measuring the corresponding voltage with an analog-to-digital converter (A/D) residing on the column driver. A calibration current source and the A/D can be switched to any column through a switching matrix. However, this technique is only applicable to passive-matrix displays, not to the higher-performance active-matrix displays which are commonly employed. Further, this technique does not include any correction for changes in OLED emitters as they age, such as OLED efficiency loss.

U.S. Pat. No. 6,504,565 by Narita et al. describes a light-emitting display which includes a light-emitting element array formed by arranging a plurality of light-emitting elements, a driving unit for driving the light-emitting element array to emit light from each of the light-emitting elements, a memory unit for storing the number of light emissions for each light-emitting element of the light-emitting element array, and a control unit for controlling the driving unit based on the information stored in the memory unit so that the amount of light emitted from each light-emitting element is held constant. An exposure display employing the light-emitting display, and an image-forming apparatus employing the exposure display are also disclosed. This design requires the use of a calculation unit responsive to each signal sent to each pixel to record usage, greatly increasing the complexity of the circuit design.

JP 2002-278514 by Numao Koji describes a method in which a prescribed voltage is applied to organic EL elements by a current-measuring circuit, the current flows are measured, and a temperature measurement circuit estimates the temperature of the organic EL elements. A comparison is made with the voltage value applied to the elements, the flow of current values and the estimated temperature, the changes due to aging of similarly constituted elements determined beforehand, the changes due to aging in the current-luminance characteristics, and the temperature at the time of the characteristics measurements for estimating the current-luminance characteristics of the elements. Then, the total sum of the amount of currents supplied to the elements in the interval during which display data are displayed is changed, which can provide the luminance that is to be originally displayed, based on the estimated values of the current-luminance characteristics, the values of the current flowing in the elements, and the display data. This design presumes a predictable relative use of pixels and does not accommodate differences in actual usage of groups of pixels or of individual pixels. Hence, correction for color or spatial groups is likely to be inaccurate over time. Moreover, the integration of temperature and multiple current sensing circuits within the display is required. This integration is complex, reduces manufacturing yields, and takes up space within the display.

US Patent Publication No. 2003/0122813 by Ishizuki et al. discloses a display panel driving device and driving method for providing high-quality images without irregular luminance even after long-time use. The light-emission drive current flowing is measured while each pixel successively and independently emits light. Then the luminance is corrected for each input pixel data based on the measured drive current values. According to another aspect, the drive voltage is adjusted such that one drive current value becomes equal to a predetermined reference current. In a further aspect, the current is measured while an offset current, corresponding to a leak current of the display panel, is added to the current output from the drive voltage generator circuit, and the resultant current is supplied to each of the pixel portions. The measurement techniques are iterative, and therefore slow.

Arnold et al., in U.S. Pat. No. 6,995,519, teach a method of compensating for aging of an OLED device (emitter) This method relies on the drive transistor to drive current through the OLED emitter. However, drive transistors known in the art have non-idealities that are confounded with the OLED emitter aging in this method. Low-temperature polysilicon (LTPS) transistors can have nonuniform threshold voltages and mobilities across the surface of a display, and amorphous silicon (a-Si)transistors have a threshold voltage which changes with use. The method of Arnold et al. will therefore not provide complete compensation for OLED efficiency losses in circuits wherein transistors show such effects. Additionally, when methods such as reverse bias are used to mitigate a-Si transistor threshold voltage shifts, compensation of OLED efficiency loss can become unreliable without appropriate and potentially expensive tracking and prediction of reverse bias effects.

There is a need therefore for a more complete compensation approach for electroluminescent displays.

SUMMARY OF THE INVENTION

It is therefore an object of the present invention to compensate for efficiency changes in OLED emitters in the presence of transistor aging. This is achieved by a method of providing a drive signal to a gate electrode of a drive transistor in an electroluminescent (EL) subpixel, comprising:

a) providing the EL subpixel having the drive transistor, an EL emitter, and a readout transistor, wherein the drive transistor has a first electrode, a second electrode, and the gate electrode;

b) providing a first voltage source and a first switch for selectively connecting the first voltage source to the first electrode of the drive transistor;

c) connecting the EL emitter to the second electrode of the drive transistor;

d) providing a second voltage source connected to the EL emitter;

e) connecting the first electrode of the readout transistor to the second electrode of the drive transistor;

f) providing a current source and a third switch for selectively connecting the current source to the second electrode of the readout transistor;

g) providing a voltage measurement circuit connected to the second electrode of the readout transistor;

h) opening the first switch, closing the third switch, and using the voltage measurement circuit to measure the voltage at the second electrode of the readout transistor to provide a first emitter-voltage signal;

i) using the first emitter-voltage signal to provide an aging signal representative of the efficiency of the EL emitter;

j) receiving an input signal;

k) using the aging signal and the input signal to produce a compensated drive signal; and l) providing the compensated drive signal to the gate electrode of the drive transistor to compensate for changes in efficiency of the EL emitter.

ADVANTAGES

An advantage of this invention is an electroluminescent display, such as an OLED display, that compensates for the aging of the organic materials in the display wherein circuitry or transistor aging or nonuniformities are present, without requiring extensive or complex circuitry for accumulating a continuous measurement of light-emitting element use or time of operation. It is a further advantage of this invention that it uses simple voltage measurement circuitry. It is a further advantage of this invention that by making all measurements of voltage, it is more sensitive to changes than methods that measure current. It is a further advantage of this invention that a single select line can be used to enable data input and data readout. It is a further advantage of this invention that characterization and compensation of OLED changes are unique to the specific element and are not impacted by other elements that may be open-circuited or short-circuited.

DETAILED DESCRIPTION OF THE INVENTION

Figure 2:
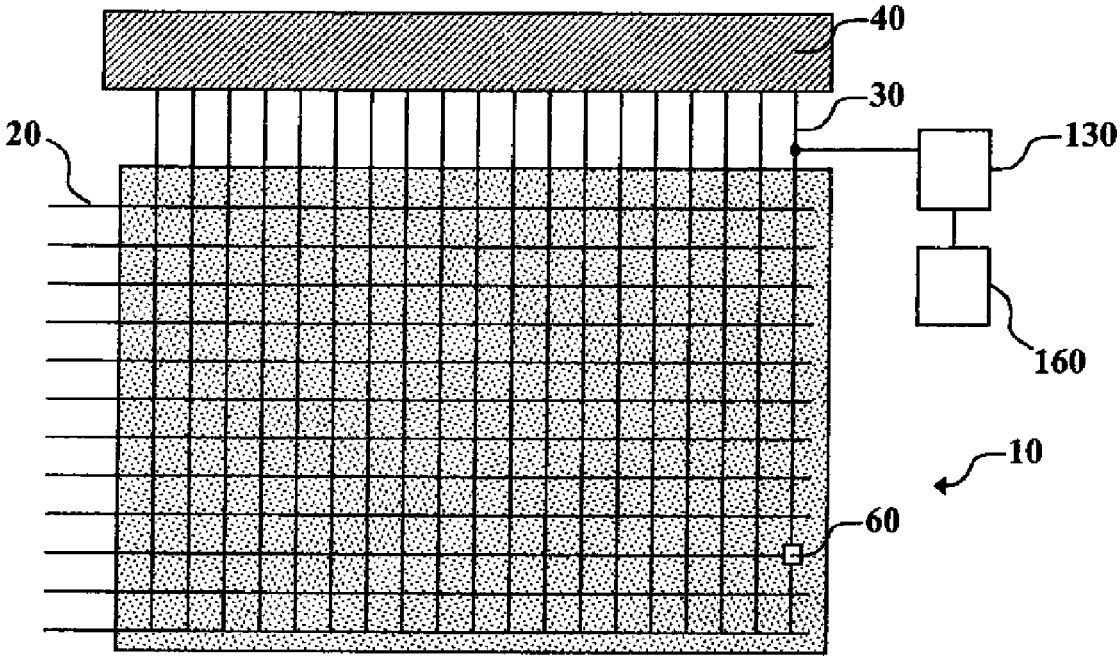
FIG. 2 is a schematic diagram of one embodiment of an electroluminescent (EL) display that can be used in the practice of the present invention.

Turning now to FIG. 2, there is shown a schematic diagram of one embodiment of an electroluminescent (EL) display that can be used in the practice of the present invention. EL display 10 comprises an array of a predetermined number of EL subpixels 60 arranged in rows and columns. EL display 10 includes a plurality of row select lines 20 wherein each row of EL subpixels 60 has a row select line 20. EL display 10 includes a plurality of readout lines 30 wherein each column of EL subpixels 60 has a readout line 30. Each readout line 30 is connected to a third switch 130, which selectively connects readout line 30 to current source 160 during the calibration process Although not shown for clarity of illustration, each column of EL subpixels 60 also has a data line as is well-known in the art. The plurality of readout lines 30 is connected to one or more multiplexers 40, which permits parallel/sequential readout of signals from EL subpixels, as will become apparent. Multiplexer 40 can be a part of the same structure as EL display 10, or can be a separate construction that can be connected to or disconnected from EL display 10. Note that "row" and "column" do not imply any particular orientation of the panel.

Figure 3:
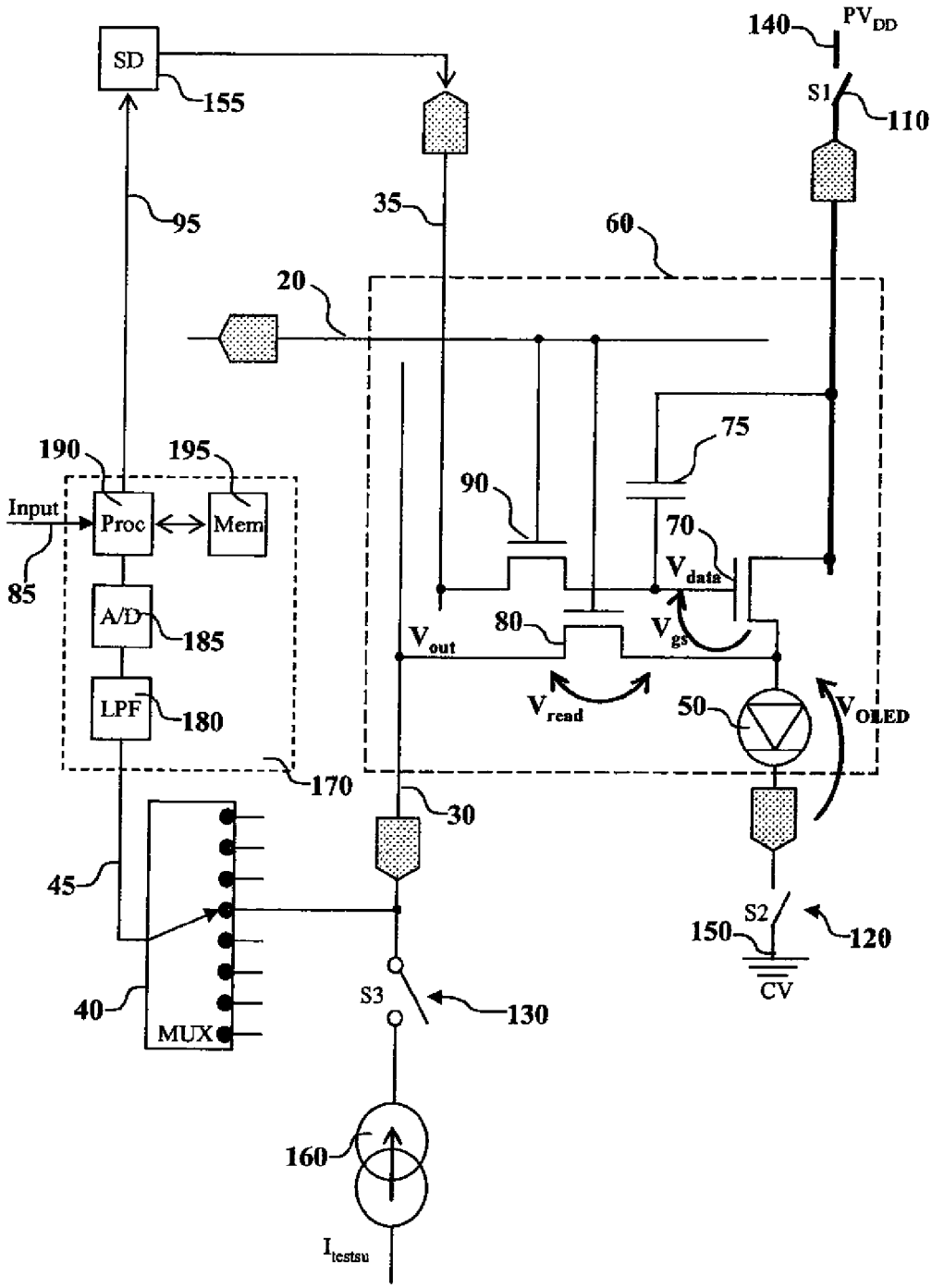
FIG. 3 is a schematic diagram of one embodiment of an EL subpixel and connected components that can be used in the practice of the present invention.

Turning now to FIG. 3, there is shown a schematic diagram of one embodiment of an EL subpixel that can be used in the practice of the present invention. EL subpixel 60 includes EL emitter 50, drive transistor 70, capacitor 75, readout transistor 80, and select transistor 90. Each of the transistors has a first electrode, a second electrode, and a gate electrode. A first voltage source 140 is selectively connected to the first electrode of drive transistor 70 by first switch 110, which can be located on the EL display substrate or on a separate structure. By connected, it is meant that the elements are directly connected or connected via another component, e.g. a switch, a diode, or another transistor. The second electrode of drive transistor 70 is connected to EL emitter 50, and a second voltage source 150 can be selectively connected to EL emitter 50 by second switch 120, which can also be off the EL display substrate. The EL emitter 50 can also be connected directly to the second voltage source 150. At least one first switch 1 10 and second switch 120 are provided for the EL display. Additional first and second switches can be provided if the EL display has multiple powered subgroupings of pixels. The drive transistor 70 can be used as the first switch 110 by operating it in reverse bias so that substantially no current flows. Methods for operating transistors in reverse bias are known in the art. In normal display mode, the first and second switches are closed, and other switches (described below) are open. The gate electrode of drive transistor 70 is connected to select transistor 90 to selectively provide data from data line 35 to drive transistor 70 as is well known in the art. Each of the plurality of row select lines 20 is connected to the gate electrodes of the select transistors 90 in the corresponding row of EL subpixels 60. The gate electrode of select transistor 90 is connected to the gate electrode of readout transistor 80.

The first electrode of readout transistor 80 is connected to the second electrode of drive transistor 70 and to EL emitter 50. Each of the plurality of readout lines 30 is connected to the second electrodes of the readout transistors 80 in the corresponding column of EL subpixels 60. Readout line 30 is connected to third switch 130. A respective third switch 130 (S3) is provided for each column of EL subpixels 60. The third switch permits current source 160 to be selectively connected to the second electrode of readout transistor 80. Current source 160, when connected by the third switch, permits a predetermined constant current to flow into EL subpixel 60. Third switch 130 and current source 160 can be provided located on or off the EL display substrate. The current source 160 can be used as the third switch 130 by setting it to a high-impedance (Hi-Z) mode so that substantially no current flows. Methods for setting current sources to high-impedance modes are known in the art.

The second electrode of readout transistor 80 is also connected to voltage measurement circuit 170, which measures voltages to provide signals representative of characteristics of EL subpixel 60. Voltage measurement circuit 170 includes analog-to-digital converter 185 for converting voltage measurements into digital signals, and processor 190. The signal from analog-to-digital converter 185 is sent to processor 190. Voltage measurement circuit 170 can also include memory 195 for storing voltage measurements, and a low-pass filter 180. Voltage measurement circuit 170 is connected through multiplexer output line 45 and multiplexer 40 to a plurality of readout lines 30 and readout transistors 80 for sequentially reading out the voltages from a predetermined number of EL subpixels 60. If there are a plurality of multiplexers 40, each can have its own multiplexer output line 45. Thus, a predetermined number of EL subpixels can be driven simultaneously. The plurality of multiplexers permits parallel reading out of the voltages from the various multiplexers 40, and each multiplexer permits sequential reading out of the readout lines 30 attached to it. This will be referred to herein as a parallel/sequential process.

Processor 190 can also be connected to data line 35 by way of control line 95 and source driver 155. Thus, processor 190 can provide predetermined data values to data line 35 during the measurement process to be described herein. Processor 190 can also accept display data via input signal 85 and provide compensation for changes as will be described herein, thus providing compensated data to data line 35 using source driver 155 during the display process. Source driver 155 can comprise a digital-to-analog converter or programmable voltage source, a programmable current source, or a pulse-width modulated voltage ("digital drive") or current driver, or another type of source driver known in the art.

The embodiment shown in FIG. 3 is a non-inverted, NMOS subpixel. Other configurations as known in the art can be employed with the present invention. The EL emitter 50 can be an OLED emitter or other emitter types known in the art. When the EL emitter 50 is an OLED emitter, the EL subpixel 60 is an OLED subpixel. The drive transistor 70, and the other transistors (80, 90) can be low-temperature polysilicon (LTPS), zinc oxide (ZnO), or amorphous silicon (a-Si) transistors, or transistors of another type known in the art, Each transistor (70, 80, 90) can be N-channel or P-channel, and the EL emitter 50 can be connected to the drive transistor 70 in an inverted or non-inverted arrangement. In an inverted configuration as known in the art, the polarities of the first and second power supplies are reversed, and the EL emitter 50 conducts current towards the drive transistor rather than away from it. Current source 160 of the present invention must therefore source a negative current, that is, behave as a current sink, to draw current through the EL emitter 50.

As an EL emitter 50, e.g. an OLED emitter, is used, its luminous efficiency, often expressed in cd/A, can decrease and its resistance can increase. Both of these effects can cause the amount of light emitted by an EL emitter to decrease over time. The amount of such decrease will depend upon the use of the EL emitter. Therefore, the decrease can be different for different EL emitters in a display, which effect is herein termed spatial variations in characteristics of EL emitters 50. Such spatial variations can include differences in brightness and color balance in different parts of the display, and image "burn-in" wherein an of t-displayed image (e.g. a network logo) can cause a ghost of itself to always show on the active display. It is desirable to compensate for such changes in the threshold voltage to prevent such problems.

Figure 4A:
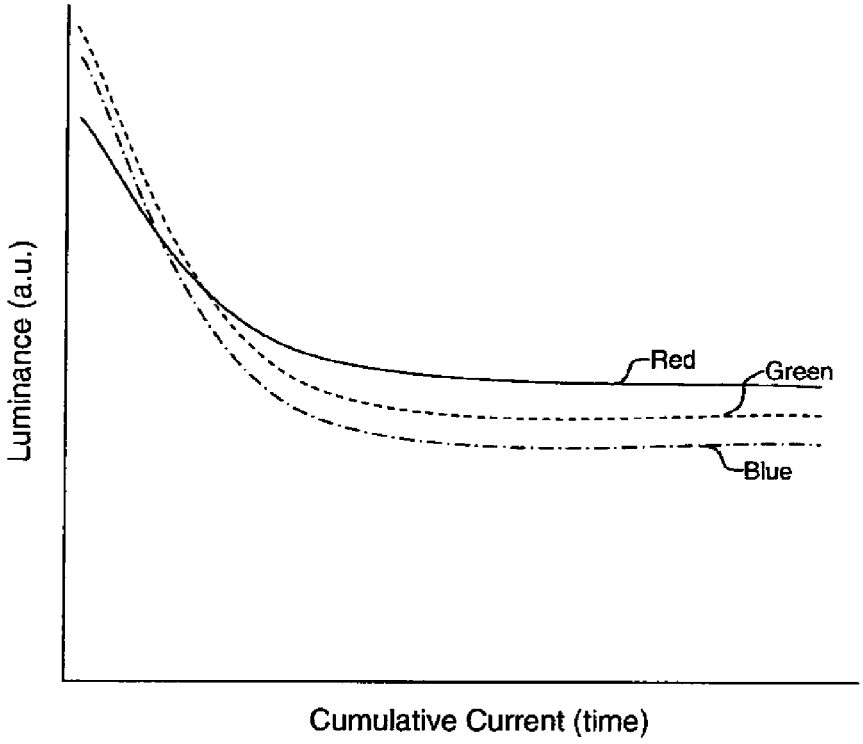
FIG. 4A is a diagram illustrating the effect of aging of an OLED emitter on luminance efficiency.

Turning now to FIG. 4A, there is shown a diagram illustrating the effect of aging of an OLED emitter on luminance efficiency as current is passed through the OLED emitters. The three curves represent typical performance of different light emitters emitting differently colored light (e.g. R,G,B representing red, green, and blue light emitters, respectively) as represented by luminance output over time or cumulative current. The decay in luminance between the differently colored light emitters can be different. The differences can be due to different aging characteristics of materials used in the differently colored light emitters, or due to different usages of the differently colored light emitters. Hence, in conventional use, with no aging correction, the display can become less bright and the color of the display—in particular the white point—can shift.

Figure 4B:
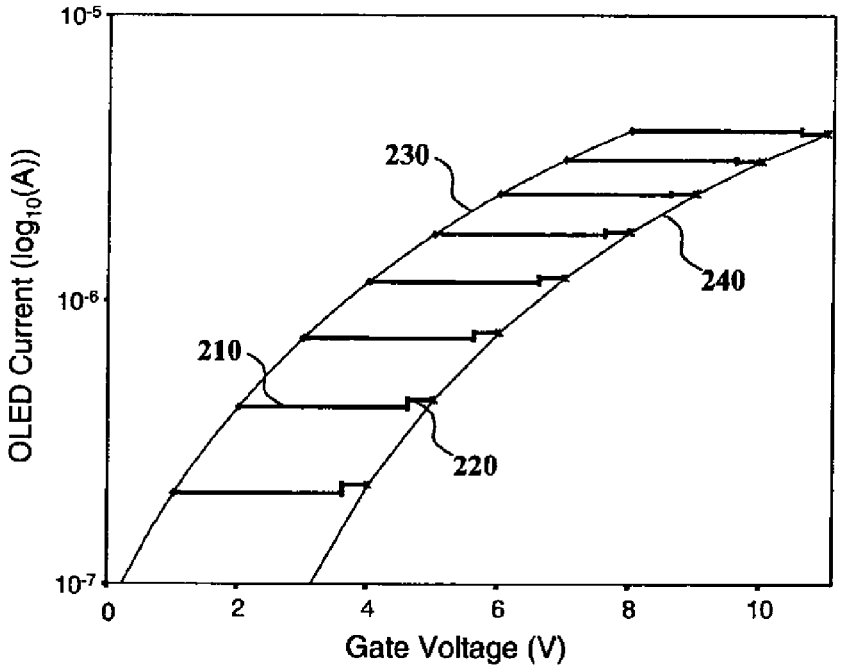
FIG. 4B is a diagram illustrating the effect of aging of an OLED emitter or a drive transistor on emitter current.

Turning now to FIG. 4B, there is shown a diagram illustrating the effect of aging of an OLED emitter or a drive transistor, or both, on emitter to current. The abscissa of FIG. 4B represents the gate voltage at drive transistor 70, and the ordinate represents the base-10 logarithm of the current through the drive transistor at that gate voltage. Unaged curve 230 shows a subpixel before aging. As the subpixel ages, a greater voltage is required to obtain a desired current; that is, the curve moves by an amount ΔV to aged curve 240. ΔV is the sum of the change in threshold voltage ($\Delta V_{th}$, 210) and the change in OLED voltage resulting from a change in OLED emitter resistance ($\Delta V_{OLED}$, 220), as shown. This change results in reduced performance. A greater gate voltage is required to obtain a desired current. The relationship between the OLED current (which is also the drain-source current through the drive transistor), OLED voltage, and threshold voltage at saturation is:

$$I_{oled} = \frac{W\bar{\mu}C_0}{2L}(V_{gs} - V_{th})^2 = \frac{K}{2}(V_g - V_{oled} - V_{th})^2 \quad \text{(Eq. 1)}$$

where W is the TFT Channel Width, L is the TFT Channel Length, μ is the TFT mobility, $C_0$ is the Oxide Capacitance per Unit Area, $V_g$ is the gate voltage, $V_{gs}$ is voltage difference between gate and source of the drive transistor. For simplicity, we neglect dependence of μ on $V_{gs}$. Thus, to keep the current constant, changes in $V_{th}$ and $V_{OLED}$ must be compensated for.

Figure 5:
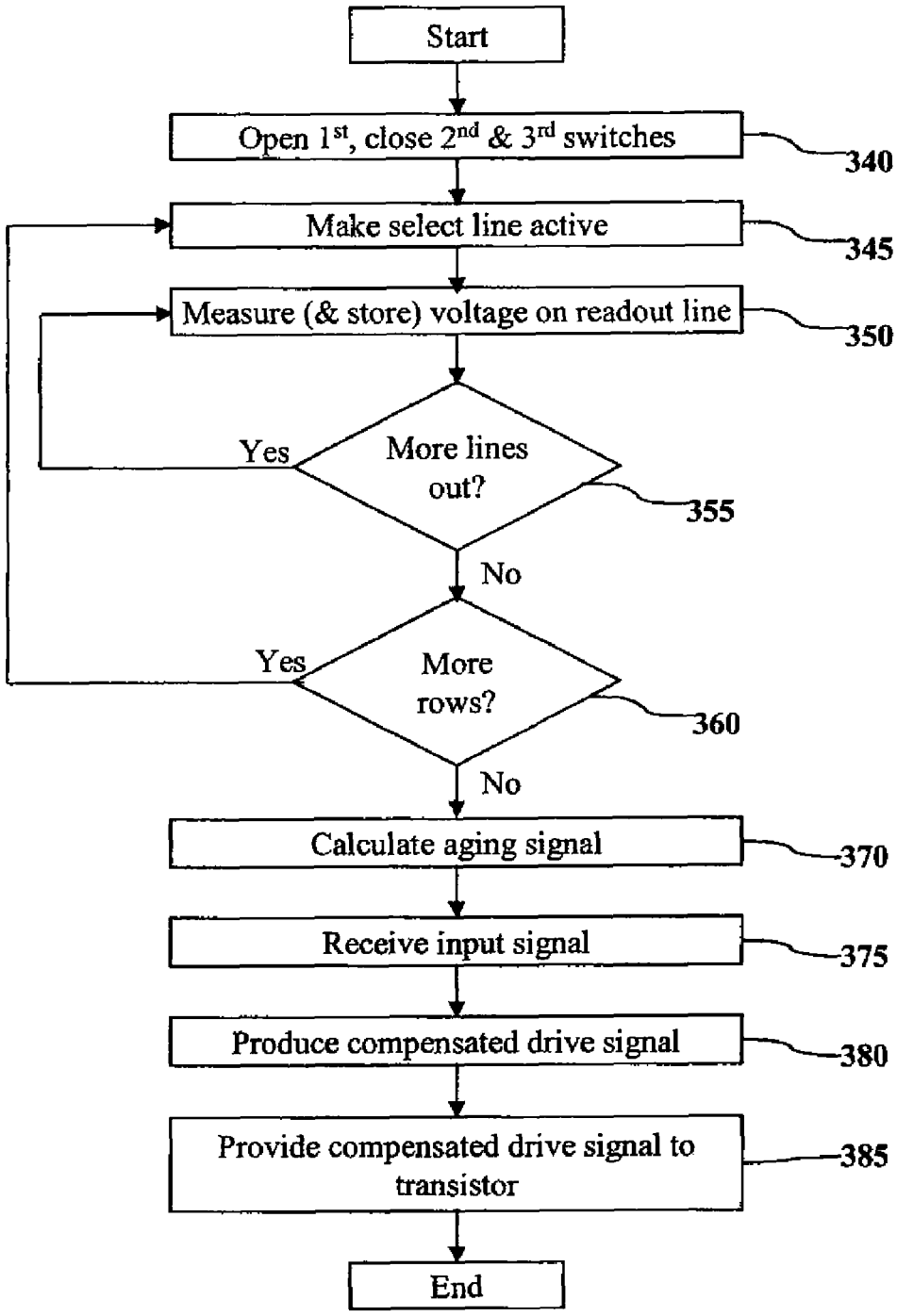
FIG. 5 is a block diagram of one embodiment of the method of the present invention.

Turning now to FIG. 5, and referring also to FIG. 3, there is shown a block diagram of one embodiment of the method of the present invention.

To measure the characteristics of an EL emitter 50, first switch 110 is opened, and second switch 120 and third switch 130 are closed (Step 340). Select line 20 is made active for a selected row to turn on readout transistor 80 (Step 345). A current, $I_{testsu}$, thus flows from current source 160 through EL emitter 50 to second voltage source 150. The value of current through current source 160 is selected to be less than the maximum current possible through EL emitter 50; a typical value will be in the range of 1 to 5 microamps and will be constant for all measurements during the lifetime of the EL subpixel. More than one measurement value can be used in this process, e.g. measurement can be performed at 1, 2, and 3 microamps. Taking measurements at more than one measurement value permits forming a complete I-V curve of the EL subpixel 60. Voltage measurement circuit 170 is used to measure the voltage on readout line 30 (Step 350). This voltage is the voltage $V_{out}$ at the second electrode of readout transistor 80 and can be used to provide a first emitter-voltage signal $V_2$ that is representative of characteristics of EL emitter 50, including the resistance and thus efficiency of EL emitter 50.

The voltages of the components in the subpixel are related by:

$$V_2 = CV + V_{OLED} + V_{read} \quad \text{(Eq. 2)}$$

The values of these voltages will cause the voltage at the second electrode of readout transistor 80 ($V_{out}$) to adjust to fulfill Eq. 2. Under the conditions described above, CV is a set value and $V_{read}$ can be assumed to be constant as the current through the readout transistor is low and does not vary significantly over time. $V_{OLED}$ will be controlled by the value of current set by current source 160 and the current-voltage characteristics of EL emitter 50.

$V_{OLED}$ can change with age-related changes in EL emitter 50. To determine the change in $V_{OLED}$, two separate test measurements are performed at different times. The first measurement is performed at a first time, e.g. when EL emitter 50 is not degraded by aging. This can be any time before EL subpixel 60 is used for display purposes. The value of the voltage $V_2$ for the first measurement is the first emitter-voltage signal (hereinafter $V_{2a}$), and is measured and stored. At a second time different from the first time, e.g. after EL emitter 50 has aged by displaying images for a predetermined time, the measurement is repeated and a second emitter-voltage signal (hereinafter $V_{2b}$) is stored.

If there are additional EL subpixels in the row to be measured, multiplexer 40 connected to a plurality of readout lines 30 is used to permit voltage measurement circuit 170 to sequentially measure each of a predetermined number of EL subpixels, e.g. every subpixel in the row (decision step 355), and provide a corresponding first and second emitter-voltage signal for each subpixel. If the display is sufficiently large, it can require a plurality of multiplexers wherein the first and second emitter-voltage signals are provided in a parallel/sequential process. If there are additional rows of subpixels to be measured in EL display 10, Steps 345 to 355 are repeated for each row (decision step 360). To accelerate the measurement process, each of the predetermined number of EL subpixels can be driven simultaneously so that any settling time will have elapsed when the measurement is taken.

Changes in EL emitter 50 can cause changes to $V_{OLED}$ to maintain the test current $I_{testsu}$. These $V_{OLED}$ changes will be reflected in changes to $V_2$. The two stored emitter-voltage signal ($V_2$) measurements for each EL subpixel 60 can therefore be compared to calculate an aging signal $\Delta V_2$ representative of the efficiency of the EL emitter 50 (Step 370) as follows:

$$\Delta V_2 = V_{2b} - V_{2a} = \Delta V_{OLED} \quad \text{(Eq. 3)}$$

The above method requires that the corresponding first emitter-voltage signal for each subpixel be stored in memory for later comparison. A less memory-intensive method can be used that does not require an initial measurement, but can compensate for spatial variations in $V_{OLED}$. After aging, the second emitter-voltage signal ($V_{2b}$) can be recorded for each subpixel with selected values for current source 160, as previously described. Then, the subpixel with the minimum $V_{OLED}$ shift (that is, the minimum measured $V_{2b}$) is selected from the population of subpixels measured to be a target signal. This target signal serves as the first emitter-voltage signal ($V_{2a,tgt}$) for all subpixels. The aging signals $\Delta V_2$ for each of the plurality of subpixels can then be expressed as:

$$\Delta V_2 = V_{2b} - V_{2a,tgt} \quad \text{(Eq. 4)}$$

The aging signal for an EL subpixel 60 can then be used to compensate for changes in characteristics of that EL subpixel.

For compensating for EL aging, it is necessary to correct as described above for $\Delta V_{OLED}$ (related to $\Delta V_2$). However, a second factor also affects the luminance of the EL emitter and changes with age or use: the efficiency of the EL emitter decreases with use, which decreases the light emitted at a given current (as shown in FIG. 4A). In addition to the relations above, a relationship has been found between the decrease in luminance efficiency of an EL emitter and $\Delta V_{OLED}$, that is, where the EL luminance for a given current is a function of the change in $V_{OLED}$:

$$\frac{L_{OLED}}{I_{OLED}} = f(\Delta V_{OLED}) \quad \text{(Eq. 5)}$$

Figure 6:
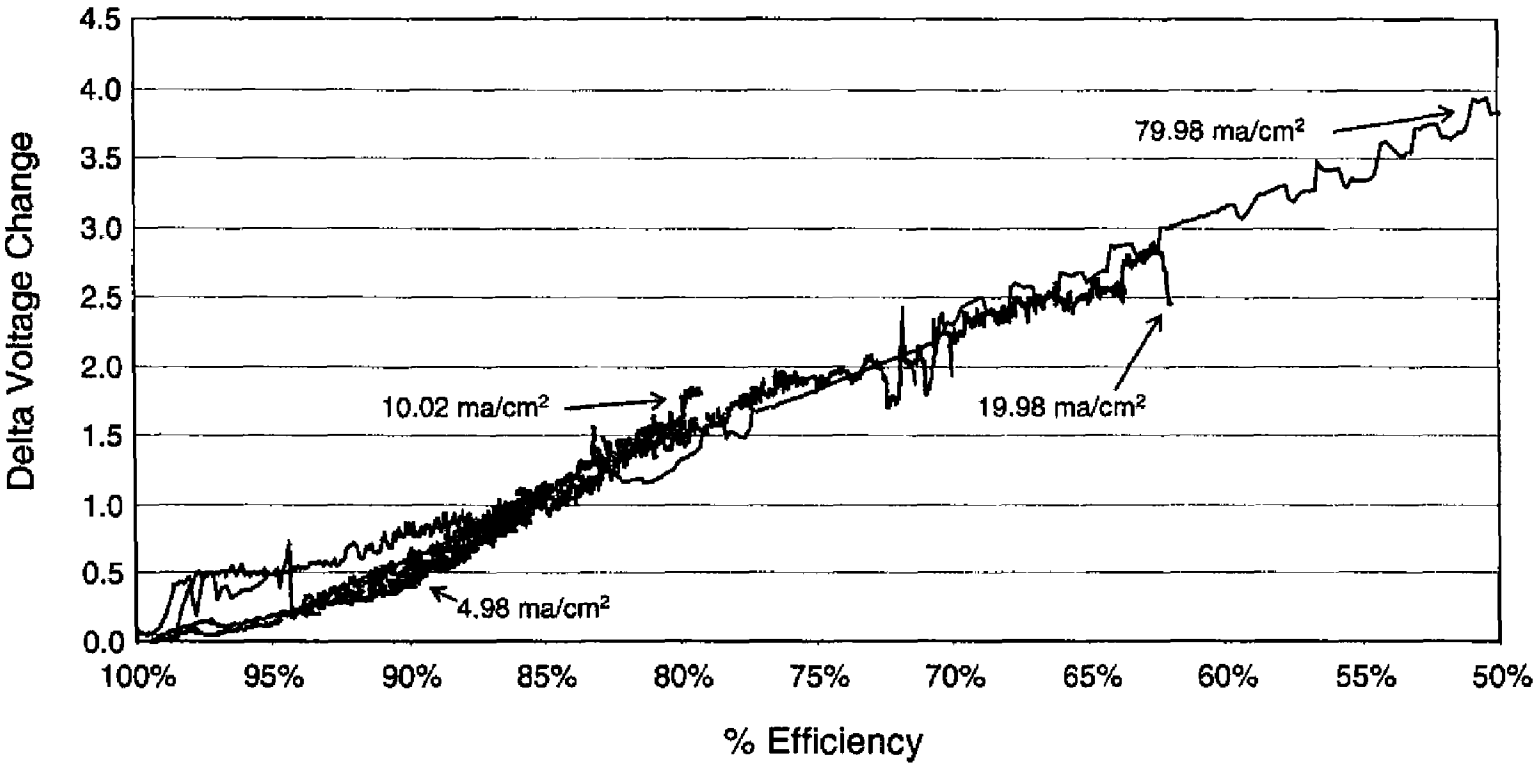
FIG. 6 is a graph showing the relationship between OLED efficiency and the change in OLED voltage.

An example of the relationship between luminance efficiency and $\Delta V_{OLED}$ for a tested OLED emitter is shown in the graph in FIG. 6. FIG. 6 shows this relationship at a variety of fade current densities, listed in the legend. As shown, the relationship has been experimentally determined to be approximately independent of fade current density. By measuring the luminance decrease and its relationship to $\Delta V_{OLED}$ with a given current, a change in corrected signal necessary to cause the EL emitter 50 to output a nominal luminance can be determined. This measurement can be done on a model system and thereafter stored in a lookup table or used as an algorithm. This modeling can be performed at a variety of fade current densities for more accurate results, or at a single fade current density to reduce cost, using the determination shown in FIG. 6 that the relationship between OLED voltage rise and OLED efficiency loss is approximately independent of fade current density.

To compensate for the above changes in characteristics of EL subpixel 60, an input signal $V_{data}$ is received (Step 375). The aging signals and the input signal can then be used to produce a compensated drive signal (Step 380). An equation of the following form can be used:

$$\Delta V_{data} = f_2(\Delta V_2) + f_3(\Delta V_2) \quad \text{(Eq. 6)}$$

where $\Delta V_{data}$ is an offset voltage on the gate electrode of drive transistor 70 necessary to maintain the desired luminance, $f_2(\Delta V_2)$ is a correction for the change in EL resistance and $f_3(\Delta V_2)$ is a correction for the change in EL efficiency. In this case, the compensated drive signal $V_{comp}$ is:

$$V_{comp} = V_{data} + \Delta V_{data} \quad \text{(Eq. 7)}$$

The compensated drive signal $V_{comp}$ is provided to the gate electrode of the drive transistor (Step 385) using source driver 155 to compensate for changes in voltage and efficiency of the EL emitter.

When compensating an EL display having a plurality of EL subpixels, each subpixel is measured to provide a plurality of corresponding first and second emitter-voltage signals, and a plurality of corresponding aging signals is provided, as described above. A corresponding input signal for each subpixel is received, and a corresponding compensated drive signal calculated as above using the corresponding aging signals. The compensated drive signal corresponding to each subpixel in the plurality of subpixels is provided to the gate electrode of that subpixel using source driver 155 as is known in the art. This permits compensation for changes in efficiency of each EL emitter in the plurality of EL subpixels.

The EL display can include a controller, which can include a lookup table or algorithm to compute an offset voltage for each EL emitter. The offset voltage is computed to provide corrections for changes in current due to changes in the threshold voltage of drive transistor 70 and aging of EL emitter 50, as well as providing a current increase to compensate for efficiency loss due to aging of EL emitter 50, thus providing a complete EL aging compensation solution. These changes are applied by the controller to correct the light output to the nominal luminance value desired. By controlling the signal applied to the EL emitter, an EL emitter with a constant luminance output and increased lifetime at a given luminance is achieved. Because this method provides a correction for each EL emitter in a display, it will compensate for spatial variations in the characteristics of the plurality of EL subpixels, and specifically for changes in efficiency of each EL emitter.

Figure 1:
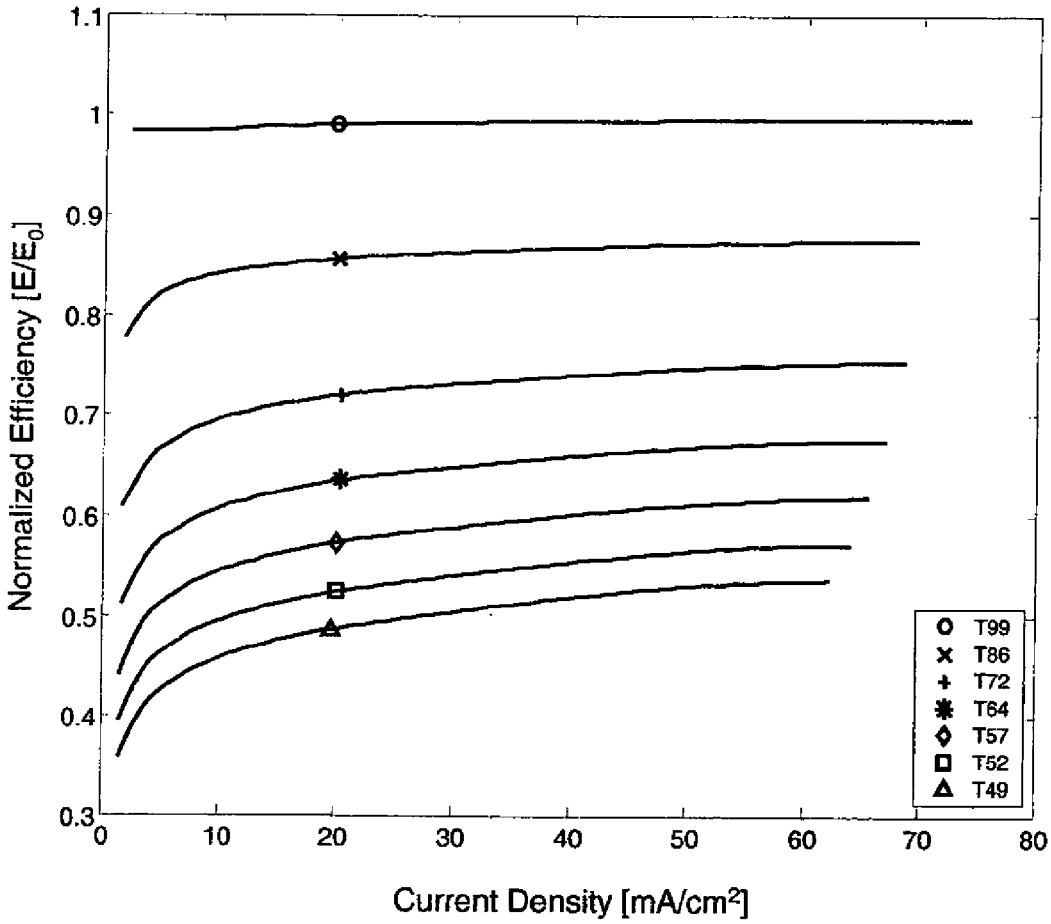
FIG. 1 is a graph showing the relationship between OLED efficiency, OLED age, and OLED drive current density.

Referring to FIG. 1, an additional relationship has been found between the luminance efficiency of an OLED emitter and the current density with which that emitter is driven. In general, OLED emitters can exhibit variations in OLED efficiency due to drive level, expressed as current, current density, or any other value which maps bijectively to current density for a given OLED emitter. This relationship can be combined with that expressed in Eq. 5, above, for a more accurate model of where the OLED luminance for a given current:

$$\frac{L_{OLED}}{I_{OLED}} = f(\Delta V_{OLED}, I_{ds}) \quad \text{(Eq. 8)}$$

where $\Delta V_{OLED}$ is the change on OLED voltage due to again, measured at current $I_{testsu}$, as described above, and $I_{ds}$ is the current through the OLED which would ideally result from driving input signal 85 (FIG. 3). The value of the input signal 85, or other drive level values, can be substituted for $I_{ds}$ in this equation. Each curve in FIG. 1 shows the relationship between current density, $I_{ds}$ divided by emitter area, and efficiency ($L_{OLED}/I_{OLED}$) for an OLED aged to a particular point. The ages are indicated in the legend using the T notation known in the art: e.g. T86 means 86% efficiency at a test current density oft in this case, 20 mA/cm$^2$.

To compensate for the above changes in characteristics of EL subpixel 60, e.g. an OLED subpixel, one can use the aging signals $\Delta V_2$, along with the models described above, including Eq. 8 involving the input signal, in an equation of the form:

$$\Delta V_{data} = f_2(\Delta V_2) + f_3(\Delta V_2, I_{ds}) \quad \text{(Eq. 9)}$$

where $\Delta V_{data}$ is an offset voltage on the gate electrode of drive transistor 70 necessary to maintain the desired luminance, $f_2(\Delta V_2)$ is a correction for the change in EL resistance and $f_3(\Delta V_2, I_{ds})$ is a correction for the change in EL efficiency at commanded current $I_{ds}$. Function $f_3$ can be a fit of curves such as those shown in FIG. 1. As above, any drive level value may be used in the second term of Eq. 9. The value of $\Delta V_{data}$ from Eq. 9 can then be used in Eq. 7 to provide a compensated drive signal. This can provide a more accurate compensation solution.

In a preferred embodiment, the invention is employed in a display that includes Organic Light Emitting Diodes (OLEDs), which are composed of small molecule or polymeric OLEDs as disclosed in but not limited to U.S. Pat. No. 4,769,292, by Tang et al., and U.S. Pat. No. 5,061,569, by VanSlyke et al. Many combinations and variations of organic light emitting displays can be used to fabricate such a display.

The invention has been described in detail with particular reference to certain preferred embodiments thereof, but it will be understood that variations and modifications can be effected within the spirit and scope of the invention.

PARTS LIST

10 EL display
20 select line
30 readout line
35 data line
40 multiplexer

45 multiplexer output line
50 EL emitter
60 EL subpixel
70 drive transistor
75 capacitor
80 readout transistor
85 input signal
90 select transistor
95 control line
110 first switch
120 second switch
130 third switch
140 first voltage source
150 second voltage source
155 source driver
160 current source
170 voltage measurement circuit
180 low-pass filter
185 analog-to-digital converter
190 processor
195 memory
210 $\Delta V_{th}$
220 $\Delta V_{OLED}$
230 unaged curve
240 aged curve
340 step
345 step
350 step
355 decision step
360 decision step
370 step
375 step
380 step
385 step

The invention claimed is:

1. A method of providing a drive signal to a gate electrode of a drive transistor in an electroluminescent (EL) subpixel, the method comprising:

(a) providing the EL subpixel comprising the drive transistor, an EL emitter, and a readout transistor, the drive transistor comprising: a first electrode, a second electrode, and the gate electrode;

(b) providing a first voltage source and a first switch for selectively connecting the first voltage source to the first electrode of the drive transistor;

(c) connecting the EL emitter to the second electrode of the drive transistor;

(d) providing a second voltage source connected to the EL emitter;

(e) connecting the first electrode of the readout transistor to the second electrode of the drive transistor;

(f) providing a current source and a third switch for selectively connecting the current source to the second electrode of the readout transistor;

(g) providing a voltage measurement circuit connected to the second electrode of the readout transistor;

(h) opening the first switch, closing the third switch, and using the voltage measurement circuit to measure the voltage at the second electrode of the readout transistor to provide a first emitter-voltage signal;

(i) using the first emitter-voltage signal to provide an aging signal representative of the efficiency of the EL emitter;

(j) receiving an input signal;

(k) using the aging signal and the input signal to produce a compensated drive signal;

(l) providing the compensated drive signal to the gate electrode of the drive transistor to compensate for changes in efficiency of the EL emitter; and providing a second switch for selectively connecting the EL emitter to the second voltage source, wherein step (h) includes closing the second switch.

2. The method of claim 1, wherein step (h) further includes:

(1) measuring the voltage at the second electrode of the readout transistor at a first time to provide the first emitter-voltage signal;

(2) storing the first emitter-voltage signal;

(3) measuring a second emitter-voltage signal at a second time, the second time being different from the first time; and (4) storing the second emitter-voltage signal.

3. The method of claim 2, wherein step (1) further includes comparing the stored first and second emitter-voltage signals to provide the aging signal.

4. The method of claim 1, wherein the voltage measurement circuit includes an analog-to-digital converter.

5. The method of claim 4, wherein the voltage measurement circuit further includes a low-pass filter.

6. The method of claim 1, further comprising:

providing a plurality of EL subpixels, wherein steps (h) and (i) are performed for each EL subpixel to produce a plurality of corresponding aging signals, and wherein steps (j) through (l) are performed for each of the plurality of subpixels using the corresponding aging signals.

7. The method of claim 6, wherein step (h) is performed for a predetermined number of such EL subpixels during which the predetermined number of subpixels are driven simultaneously.

8. The method of claim 6, wherein the EL subpixels are arranged in rows and columns, the method further comprising providing a plurality of row select lines connected to the gate electrodes of corresponding select transistors and a plurality of readout lines connected to the second electrodes of corresponding readout transistors.

9. The method of claim 8, further comprising using a multiplexer connected to the plurality of readout lines for sequentially measuring each of the predetermined number of EL subpixels to provide corresponding first emitter-voltage signals.

10. The method of claim 1, further comprising:

providing a select transistor connected to the gate electrode of the drive transistor, wherein the gate electrode of the select transistor is connected to the gate electrode of the readout transistor.

11. The method of claim 1, wherein:

each EL emitter comprises an OLED emitter; and each EL subpixel comprises an OLED subpixel.

12. The method of claim 1, wherein step (1) further includes:

providing a source driver; and using the source driver to provide the compensated drive signal to the gate electrode of the drive transistor.

13. The method of claim 12, wherein the source driver comprises a digital-to-analog converter.

* * * * *